US005079125A

United States Patent [19]

Anno et al.

[11] Patent Number: 5,079,125

[45] Date of Patent: Jan. 7, 1992

[54] THREE LAYERED TONER FOR ELECTROPHOTOGRAPHY

[75] Inventors: Masahiro Anno; Kazuo Ota; Junji Machida; Eiichi Sano; Makoto Kobayashi, all of Osaka, Japan

[73] Assignee: Minolta Camera Kabushiki Kaisha, Osaka, Japan

[21] Appl. No.: 515,577

[22] Filed: Apr. 27, 1990

[30] Foreign Application Priority Data

Apr. 28, 1989 [JP] Japan ..... 1-109945
Apr. 28, 1989 [JP] Japan ..... 1-109946

[51] Int. Cl.[5] ..... G03G 9/093

[52] U.S. Cl. ..... 430/111; 430/109; 430/110; 430/138

[58] Field of Search ..... 430/111, 138

[56] References Cited

U.S. PATENT DOCUMENTS 4,336,173 6/1982 Ugelstad ..... 523/205
4,459,378 7/1984 Ugelstad ..... 523/205
4,565,764 1/1986 Nakahara et al. ..... 430/138 X
4,601,967 7/1986 Suzuki et al. ..... 430/107
4,828,955 5/1989 Kasai et al. ..... 430/111

FOREIGN PATENT DOCUMENTS 275767 12/1986 Japan .
226162 10/1987 Japan .

*Primary Examiner*—Roland Martin
*Attorney, Agent, or Firm*—Burns, Doane Swecker & Mathis

[57] ABSTRACT

The present invention relates to a toner for developing electrostatic latent images comprising:

a core particle comprising resin with 1,000–100,000 in number average molecular weight ($Mn_1$), an intermediate layer coating the core particle and comprising resin with 5,000–300,000 in number average molecular weight ($Mn_2$) and, an outermost surface layer coating the intermediate layer and comprising resin with 10,000–1,000,000 in number average molecular weight ($Mn_3$);

the number average molecular weights $Mn_1$, $Mn_2$ and $Mn_3$ satisfies the relationship of;

$$Mn_1 < Mn_2 < Mn_3$$

21 Claims, No Drawings

THREE LAYERED TONER FOR ELECTROPHOTOGRAPHY

BACKGROUND OF THE INVENTION

This invention relates to toner for developing electrostatic latent images, more particularly, toner for developing electrostatic latent images used in electrophotography, electrostatic recording and electrostatic printing for formation of copied images with high quality.

In the development of electrostatic latent images in electrophotography, electrostatic recording and electrostatic printing, the electrostatic latent images formed on a photosensitive member are made visible by providing fictionally charged toner.

As a conventional method for charging toner electrically, there are known a two-component developing system in which toner is mixed and stirred with carrier to be charged electrically, and a single-component developing system in which toner is charged tribo-electrically in contact with a developing sleeve, a controlling blade, or a photosensitive member. In either method of the two, unless toner is charged uniformly, there arise disadvantages in a developing process and a transferring process.

Recently, there is provided toner of layered type in order to meet requirements for high resolving power, high quality, various functions or diverse uses.

The layered toner is formed of plural layers, each of which is given different functions so that properties required for toner such as fixing properties, coloring properties, chargeability and the like may be shown at their best.

As the fixing properties are generally given to core particles in layered toner, it is necessary that the core particle has low melting viscosity. For colored toner of layered type, the melting viscosity of the core needs to be lowered to obtain light-transmittance. On the other hand, as a coating layer plays an important role in storage properties, heat resistance and the like, it is necessary that the coating layer has high melting viscosity. Further, the core is needed to be formed of resin with high adhesive force in order to keep adhesion of the coating layer to the core material. However, when the coating layer is formed, the core material melts partially to fuse with the coating layer, with the result that the core resin is partially bared out of the surface of the toner. The partially bared resin of the core causes aggregation of toner particles in a copying machine, deterioration of storage properties of toner.

As another problem, an outermost surface layer or an intermediate layer of layered toner is liable to peel off or abrade by mixing, stirring or friction with carrier in a developing machine. If the resin with low viscosity inside the outermost surface layer appears out of the surface, it brings about changes of basic properties of toner such as heat resistance and the like.

Further, the particles which are produced by separation or abrasion influence toner or carrier each other, resulting in adverse influences on chargeability of developer and quality of copied images.

The particles peeled off from the coating layers of toner are very small, and adhered firmly to a photosensitive member. As the adhered particles are difficult to remove with a cleaner, there arise such problems as cleaning failure, filming phenomenon and the like. When fine particles (in particular, 5 μm or less in particle size) increase, the flowability of a developer decreases greatly, with the result in insufficient stirring, aggregation of developer and decrease of developing efficiency.

With respect to layered toner, Japanese Patent Laid-Open No. 61-275767 discloses layered toner formed of a layer containing magnetic body and/or coloring agent on core particle in a wet process and a capsule layer prepared by polymerizing one or more monomers selected from fluorine-containing monomers, amino-containing monomers and nitro-containing monomers. Japanese Patent Published No. 59-38583 discloses toner with coating layers formed on core particles in a wet process in which the coating layers are prepared with fine particles obtained by emulsion polymerization. Japanese Patent Laid-Open No. 62-226162 discloses toner in which fine resin particles are adhered to surfaces of colored thermoplastic resin in a wet process followed by heat treatment.

Both of the techniques above mentioned utilize the dependence of electrical properties on surface portions of toner to aim to stabilize chargeability of toner by adjusting physical properties of resin of the surface layer or shapes of the surface layers. But, these resin layers adhered to surfaces of core particles by the wet process are formed of fine resin particles fixed on core particles with the shapes of particles kept as they are. Accordingly, the resin layers do not cover the surfaces of core particles completely (that is, the layers are not dense.). Therefore, toner is influenced adversely by coloring agents, magnetic particles and the like contained in core particles, with the result that the toner particles are not charged stably. In particular, toner is preserved or used under severe conditions, a resin component of the core goes outside from between fine resin particles. The bared resin influences charging stability, much more adversely, and also brings about such a problem as aggregation of toner particles.

SUMMARY OF THE INVENTION

The object of the present invention is to solve adverse influences caused by resin of cores or intermediate layers and peeling-off of coating layers and to provide toner in which an outermost surface layer or an intermediate layer is resistant to peeling-off or abrasion caused by friction between toner particles and carrier particles or by tirring in a developing machine, and thereby, the baring-out of the resin inside the coating layer can be prevented.

The further object of the present invention is to provide toner excellent in durability, stability, formation of copied images of high quality.

DETAILED DESCRIPTION OF THE INVENTION

This invention provides toner for developing electrostatic latent images resistant to peeling-off of coating layers, excellent in durability and stability, and able to form copied images of high quality.

This invention further provides light-transmittable toner having properties as above mentioned.

The present invention has accomplished the above objects by constituting a toner particle of three layers in which molecular weight of resin forming of each layer is specified in specific relationship.

Toner for developing electrostatic latent images provided according to the present invention comprises; a core particle comprising resin with number average molecular weight ($Mn_1$) of 1,000–100,000 an intermediate layer coating the core particle comprising resin with number average molecular weight ($Mn_2$) of 5,000–300,000, and an outermost surface layer coating the intermediate layer comprising resin with number average molecular weight ($Mn_3$) of 10,000–1,000,000 the relationship of number average molecular weight $Mn_1$, $Mn_2$ and $Mn_3$ being specified by the following formula;

$$Mn_1 < Mn_2 < Mn_3$$

Toner for developing electrostatic latent images in the present invention comprises at least three layers (core particle, intermediate layer and outermost surface layer).

Core particle play a role mainly in fixing toner on copying paper. From such a viewpoint, styrene-acrylic copolymer resins and polyester resins are applied as a component of the core particle. In particular, polyester resins is tough and resistant to breakage. Some polyester resins are light-transmittable. Therefore, when the core particle is constituted of polyester resins, light-transmittable color toner excellent in color tone, fixing properties, transparency and the like may be also obtained.

In the case where styrene acrylic copolymer resins are applied as a main component of core particle, the ones having the number average molecular weight of 1,000–100,000, preferably 2,500–100,000, more preferably 4,000–20,000 are used in the present invention.

Styrene-acrylic copolymer with such a low molecular weight effects the preparation of toner excellent in hiding properties, improved fixing properties at low temperature.

If the number average molecular weight is smaller than 1,000, it may become difficult to granulate the resins. If the number average molecular weight is higher than 100,000, fixing properties may deteriorate. In particular, styrene-acrylic copolymer with number average molecular weight of 2,500–12,000 may also affect formation of light-transmittable toner or color toner.

Styrene monomers used as one monomer component of polystyrene acrylic copolymers are exemplified by styrene, o-methylstyrene, m-methylstyrene, p-methylstyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, and p-phenylstyrene, p-chlorostyrene, 3,4-dichlorostyrene, and a derivative thereof. Among these styrene monomers, styrene is most preferable.

Acrylic monomers used as the other monomer component of polystyrene acrylic copolymers are exemplified by acrylic acids or derivatives thereof, such as acrylic acid, methylacrylate, ethylacrylate, n-butylacrylate, isobutylacrylate, propylacrylate, n-octylacrylate, dodecylacrylate, 2-ethylhexylacrylate, stearylacrylate, 2-chloroethylacrylate, phenylacrylate, α-chloroethyleacrylate, a derivative thereof and the like, methacrylic acids or a derivative thereof, such as methacrylic acid, methylmethacrylate, ethylmethacrylate, propylmethacrylate, n-butylmethacrylate, iso-butylmethacrylate, propylmethacrylate, n-octylmethacrylate, dodecylmethacrylate, 2-ethylhexylmethacrylate, stearylmethacrylate, phenylmethacrylate, dimethylaminoethylmethacrylate, diethylaminoethylmethacrylate, a derivative thereof and the like, acrylonitrile, methacrylonitrile, a derivative of (metha)acrylic acid such as acrylamide and the like.

With respect to resin particles used as core particles, any resin particles may be available that are prepared by known methods, for example, by a pulverizing method, granulation methods such as emulsion polymerization, suspension polymerization and the like, wet granulation methods such as a suspension method, a spray-drying method and the like. However, because the shape and size-distribution of core particles may almost decide the shape and size distribution of resultant toner and influence on flowability, chargeability or the like of toner particles, the desirable resin particles used as core particles are as spherical as possible and have narrow distribution of particle size. Such resin particles may be prepared desirably by granulation polymerization methods such as emulsion polymerization, suspension polymerization and the like. In particular, seed polymerization method, one of granulation polymerization methods, makes it easy to prepare resin particles with high spherical degree and narrow distribution of particle size, and that to control polymerization degree. Therefore, the seed polymerization method may provide toner particles extremely suitable for the present invention.

The seed polymerization method is described in, for example, Japanese Patent Published No. 57-24369, in which part of polymerizable monomer and a polymerization initiator are added into an aqueous solvent or an aqueous solvent containing an emulsifying agent, stirred and emulsified, and then the residual part of the polymerizable monomer are added gradually to the obtained emulsion drop by drop to obtain fine particles, and then polymerization is carried out in droplets of polymerizable monomers with the fine particles as a polymerizing center.

Core particles may include a coloring agent, or a coating layer containing a coloring agent may be formed on the surface of core particles. In granulation polymerization, a coloring agent may be dissolved or dispersed in polymerizable monomer to prepare resin particles containing the coloring agent. However, it is desirable that coloring agents are not added in seed polymerization process in order to form uniform resin particles.

In the case where polyester resins are applied as a main component of core particles, the polyesters are synthesized by reacting polyol components with dicarboxylic acid. Polyol components are exemplified by ethylene glycol, triethylene glycol, 1,2-propylene glycol, 1,3-propylene glycol, 1,4-butanediol, 1,4-bis(hydroxymethyl)cyclohexane, bisphenol A, hydrogenated bisphenol A, polyoxyethylenated bisphenol A and the like.

Dicarboxylic acids are exemplified by maleic acid, fumaric acid, mesaconic acid, citraconic acid, itaconic glutaconic acid, phthalic acid, isophthalic acid, terephthalic acid, succinic acid, adipic acid, sebacic acid, malonic acid, 1,2,4-benzene tricarboxylic acid, 1,2,5-benzene tricarboxylic acid, 1,2,4-cyclohexane tricarboxylic acid, 1,2,5-cyclohexane tricarboxylic acid, 1,2,4-butane tricarboxylic acid, 1,3-dicarboxy-2-methyl-2-methylcarboxypropane, tetra(methylcarboxy)methane and the like.

Polyols as above mentioned are reacted with dicarboxylic acid to prepare polyester resins having number 2,000–15,000, more preferably 3,000–10,000. In particular, polyester resins having low number average molecular weight of 2,000–6,000 have high light-transmittance and being useful to prepare light-transmittable color toner. Polyester resins having the number average molecular weight as above mentioned are excellent in adhesivity, and makes it possible to develop toner onto not only copying paper but also a resin film for OHP and the like.

Core particles are prepared so that mean particle size may be 1–20 μm, preferably 3–15 μm more preferably 5–10 μm.

Further, resin particles used as core particles are the ones having coefficient of variation of particle size of less than 10 %, preferably less than 8%. Moreover, from the view point that resin particles are preferably as spherical as possible to achieve high spherical degree of layered toner of the present invention, core particles are prepared so that shape coefficient (SF1) is 120 or less, preferably 115 or less.

Coefficient of variation in the present invention means variation measures (%) obtained as follows; a photograph is taken with a scanning electron microscope, one hundred of particles are taken at random for measurement of particle sizes to obtain a standard deviation value The standard deviation value is represented by the square root of the total values of the square of the difference between the mean particle size and each particle size represented by the following formula;

$$\sigma = \sqrt{\frac{(x_1 - \bar{x})^2 + (x_2 - \bar{x}) + \ldots \ldots + (xn - \bar{x})^2}{n - 1}} = \sqrt{\frac{1}{n-1}\left[\Sigma\, xi^2 - \frac{(\Sigma xi)^2}{n}\right]}$$

Wherein $X_1$, $X_2$ ---, $X_n$ represent respective particle sizes of sample particles, $\bar{X}$ represents the mean value of the n particle sizes.

The standard deviation value ($\sigma$) is divided by the mean particle size ($\bar{X}$), and one hundred times the deviated value is the coefficient of variation (%).

$$\text{coefficient of variation} = \frac{\sqrt{\frac{1}{n-1}\left[\Sigma\, xi^2 - \frac{(\Sigma xi)^2}{n}\right]}}{x} \times 100$$

Shape coefficient(SF1) in the present invention is used as a parameter which shows the difference between long diameter and short diameter of a particle (distortability). SF1 is one of standards to show spherical degree of particles.

SF1 is defined as;

$$SF1 = \frac{(\text{maximum length})^2}{(\text{area})} \times \frac{(\pi)}{4} \times 100$$

wherein "area" means an average value of the projected area of a particle and "maximum length" means an average value of the longest length in the projected image of a particle.

Shape coefficient in the invention is expressed by the mean value measured with Image Analyzer (LUZEX 5000, made by Nihon Regulator K.K.), but, the value is not limited to the one measured by the above Image Analyzer, because the value does not depend generally on a kind of measuring apparatus.

The value of SF1 becomes near to 100 as the shape is closer to circle.

Core particles are coated with layers. The layers on the core particles are referred to as "intermediate layers" because they are further covered with other layers.

The intermediate layer is formed of styrene-acrylic copolymer resin. The number average molecular weight thereof is within the range of 5,000–300,000, preferably 8,000–250,000, more preferably 10,000–200,000, being higher than that of core resin. Such styrene-acrylic copolymer resin effects the improvement of the adhesivity of the intermediate layer to core particles.

If the number average molecular weight (Mn) is smaller than 5,000, it becomes difficult to prepare fine particles. Further, the aggregation of particles makes it difficult to form uniform layers on the core particles. If the number average molecular weight is bigger than 300,000, the adhesive properties becomes poor. When coloring agents are incorporated in the intermediate layer, the dispersibility of the coloring agents becomes poor, resulting the deterioration of copied images.

The thickness of an intermediate layer depends on the size of particles used for the formation of the intermediate layer as described later. But, the thickness of the intermediate layer is preferably about 1/5 or less of mean particle size of core particles. The lower limitation is not specified so far as the adverse influences caused by exposed surface of core particles are prevented.

As to a method of forming the intermediate layer, a method, in which core particles and small particles (that is resin particles) having diameters smaller than those of said core particles, concretely about 1/5 or less of said core particles, are mechanically blended in a suitable ratio to uniformly adhere the small particles to circumferences of core particles by the action of the Van der Waals' force and the electrostatic force and then the small particles are softened by the local temperature-rise resulting from, for example, an impact force to form a film, is preferably used.

With such the method, the intermediate layer easily and substantially completely covering the outer surface of the core particles can be formed without substantially changing the shape and the distribution of particle size of the core particles even though a softening point of the thermoplastic resins of which the core particles are formed is lower than that of the resins of which the intermediate layer is formed.

Apparatus, which may be suitably used in said method of forming the intermediate layer, include the hybridization system (made by Nara Kikai Seisakusho K.K.) applying the impact force in high-speed air current method, the Angmill (made by Hosokawa Micron K.K.), the Mechanomill (made by Okada Seiko K.K.) and the like.

However, the method of forming the intermediate layer is not limited by the above described methods.

In addition, here the fine resin particles for use in the formation of the intermediate layer having the mean particle size of 0.05 to 3 μm, preferably 0.1 to 1 μm, and the coefficient of variation of the distribution of particle sizes of 20 % or less, preferably 15 % or less, are used. Fine particles having the mean particle size smaller than 0.05 μm are difficult to produce. If the mean particle size is larger than 3 μm or the variation of coefficient is larger than 20 %, it is difficult to coat the surface of the core particles.

The fine resin particles used for the formation of the intermediate layer can be prepared in the same manner as the method of producing the core particles and the conditions are suitably selected so that the resin particles may have the desired copolymerization monomer ratio and particle size.

The usage of fine resin particles for the formation of intermediate layers is 5-50 parts by weight, preferably 10-30 parts by weight on the basis of 100 parts by weight of the total weight of core particles. If the usage is less than 5 parts by weight, it becomes difficult to cover intermediate layers completely, with the result that the adhesivity of outermost surface layer becomes poor and the outermost surface layers come to peel-off. If the usage exceeds 50 parts by weight, uniform intermediate layers may not be formed.

The intermediate layer may contain coloring agents. The method of forming the intermediate layer containing the coloring agents on the surface of the core particles is not specially limited. For example, merely the coloring agents can be adhered to the surface of the resin particles as the core particles by Van der Waals' force and the electrostatic force by a wet or dry method and then fixedly adhered to the core particles by the thermal or mechanical impact force and the like or the coloring agents may be fixedly adhered to the surface of the core particles together with the resin particles or the resin particles containing the coloring agents may be fixedly adhered to the surface of the core particles. Also in these cases, it is sufficient that the particle size is within the almost same range as that of the above described resin particles.

A coloring agent contained in toner for developing electrostatic latent images of the present invention is not given particular limitation and may be selected from various kinds of pigments and dyes of various colors. The coloring agent employed in the present invention is as follows;

For a yellow pigment, is available chrome yellow, zinc yellow, cadmium yellow, yellow oxide or the like;

For an orange pigment, is available chrome orange, molybdenum orange or the like;

For a red pigment, is available red iron oxide, cadmium red, red lead oxide, cadmium mercury sulfide or the like;

For a purple pigment, is available manganese violet, fast violet B, methyl biolet lake or the like;

For a blue pigment, is available prussian blue, cobalt blue, alkali blue lake, victoria blue lake, phthalocyanine blue or the like;

For a green pigment, is available chrome green, chrome oxide or the like;

For a white pigment, is available zinc white, titanium oxide, antimony white, zinc sulfide or the like;

For black pigment, is available carbon black such as furnace combustion black, channel black, or acetylene black, alternately, activated carbon, unmagnetic ferrite or the like.

For an extender pigment, is available powdery barytes, barium carbonate, clay, silica, white carbon, talc, alumina white or the like.

In use thereof, one or more than two kinds of them may be mixed. In any case, the limitation is not particularly given to the pigments or the dyes, so far as they are pollution-free, and have high coloring power.

Coloring agents may be used singly or in combination the other. Desirable usage of the coloring agents is 1-20 parts by weight, preferably 1-10 parts by weight on the basis of resin contained in toner particle. If it is more than 20 parts by weight, fixing properties of toner are lowered. If it is less than 1 part by weight, required density of copied images may not be achieved.

Intermediate layers are further coated with layers. As the coating layers are outermost, they are referred to as "outermost surface layer" in the present invention.

The number average molecular weight (Mn) of resin of core particles are made low in order to improve fixing properties, and the number average molecular weight (Mn) of resin of outermost surface layer are made high in order to improve heat resistance.

As a result, the difference of Mn between the resin of core particles and outermost surface layer becomes so large that resin particles are buried into core particles at the formation of outermost surface layers. Therefore, the core particles are not coated with layers desirably. In order to solve such a problem, intermediate layers are formed between core particles and outermost surface layers and the number average molecular weights of core particles, intermediate layers and outermost surface layers are made higher in this order in the present invention.

From this view point, the number average molecular weight (Mn) of outermost surface layers is 10,000-1,000,000, preferably 30,000-800,000, more preferably 100,000-700,000.

If the outermost surface layer is formed in such a manner, the chargeability, the developing property, the heat resistance and the like can be determined by the constitution of the outermost surface layer almost regardless of the constitution of the intermediate layer or the core particle, which are disposed inside the outermost surface layer, and thus, even though the kind, quantity and the like of the coloring agents contained in the core particles or the intermediate layer are changed, the stabilized and uniform chargeability can be given to the respective toner particles.

As to a method of forming the outermost surface layer, a method, in which resin particles containing styrene in the desired quantity are used and the outermost surface layer is formed in the same manner as the intermediate layer, may be used. Said outermost surface layer may further contains charge controlling agents if desired.

That is to say, a method, in which core particles with the intermediate layer and fine particles having particle sizes smaller than those of the core particles with the intermediate layer, concretely about 1/5 or less of the size of the core particles with the intermediate layer (that is, fine resin particles, charge controlling agent particles, if desired, or resin particles containing charge controlling agents) are mechanically blended in a suitable ratio to uniformly adhere said fine particles to a circumference of the intermediate layer by the action of Van der Waals' force and the electrostatic force and then said resin particles are softened by the local temperature-rise resulting from, for example, an impact force to form a layer, is preferably used. The resin particles for use in the formation of the outermost surface layer having a mean particle size of 0.05 to 3 μm, preferably 0.1 to 1 μm, and a coefficient of variation of the distribution of particle size of 20 % or less, preferably 15 % or less, are used. Particles having the mean particle size less than 0.05 μm are difficult to produce. If the mean particle size is larger than 3 μm or the coefficient of variation is larger than 20 %, it is difficult to form an outermost surface layer covering the intermediate layer. According to such a method, the outermost surface layer easily and substantially completely covering the surface of the intermediate layer without substantially changing the shape and distribution of particle size of said core particles with the intermediate layer even though a softening point of the resins, of which the outermost surface layer is formed, is higher than that of the resins of which the intermediate layer is formed. Furthermore, the surface shape and properties, such as flatness and surface roughness, of the toner particles obtained in the above described manner can be changed by selecting the composition and physical properties (particle size, thermal characteristics, gel component and the like) of the core particles and the particles for the formation of the outermost surface layer, and further suitably selecting the treatment conditions. As to the shape of the toner particles, the spherical shape having a very small unevenness on a surface thereof is desirable in view of the characteristics, such as fluidity, cleaning property and chargeability, of the toner particles. Apparatus, which can be suitably used in such a method, include the hybridization system applying the impact force in high-speed air current method (made by Nara Kikai Seisakusho K.K.), the Angmill (made by Hosokawa Micron K.K.), the Mechanomill (made by Okada Seiko K.K.) and the like.

However, the method of forming the resin layer is not limited by the above described method at all.

A positively chargeable agent is exemplified by Nigrosine Base EX (made by Orient Kagaku Kogyo K.K.), Quaternary Ammonium Salt P-51 (made by Orient Kagaku Kogyo K.K.), Nigrosine Bontron N-01 (made by Orient Kagaku Kogyo K.K.), Sudan Chief Schwalts BB (Solvent Black 3: Color Index 26150), Fett Schwaltz HBN (C.I. No. 26150), Brilliant Spirit Schwartz TN (made by Farben Fabriken Bayer K.K.), Zabon Schwalts X (made by Farwerke Hext K.K.), alkoxylated amine, alkylamide, chelate pigment of molybdic acid or the like.

A negatively chargeable agent is exemplified by Oil Black (Color Index 26150), Oil Black BY (made by Orient Kagaku Kogyo K.K.), Bontrona S-22 (made by Orient Kagaku Kogyo K.K.), Metal complex of salicylic acid E-81 (made by Orient Kagaku Kogyo K.K.), thioindigo pigments, sulfonylamine-derivatives of Copper phthalocyanine, Spilon Black TRH (made by Hododani Kagaku Kogyo K.K.), zinc metal complex E-84 (made by Orient Kagaku Kogyo K.K.), Bontron S-34 (made by Orient Kagaku Kogyo K.K.), Nigrosine SO (made by Orient Kagaku Kogyo K.K.), Seleschwaltz (R)G(Farben Fabriken Bayer K.K.), Chromogen Schwaltz ETOO (C.I. No. 14645), Azo Oil Black (R) (made by National aniline K.K.).

These charge controlling agents may be used singly or in combination but their quantity added in the outermost surface layer is 0.1 to 10 parts by weight, preferably 0.5 to 5 parts by weight, based on 100 parts by weight of the resins of which the outermost surface layer is formed. That is to say, if the quantity of the charge controlling agents added is less than 0.1 part by weight, a quantity of the charge controlling agents existing on the surface of the toner particle is reduced, so that the toner is wanting in charging quantity. If it exceeds 10 parts by weight, there is the possibility that the charge controlling agents are separated from the coating resin layer to be spent on the surface of carriers or mixed in the developers, whereby the durability with respect to copy is deteriorated.

Also the following monomer component having nitrogen-containing polar functional groups or fluorine may be used as the acrylic monomer component, of which the outermost surface layer is formed, in addition to the above described ones.

If the outermost surface layer is formed of the resins into which such the polar groups are introduced, these resins themselves control the charge, so that the chargeability can be given to some extent without specially adding the charge controlling agents to the outermost surface layer.

Also homopolymers of the following monomer components may be used and the above described effects can be achieved also by using fine resin particles of such the polymers in the formation of the outermost surface layer.

The nitrogen containing polar functional group is useful for controlling positive charges, and the monomer containing the same is expressed by the following formula (I):

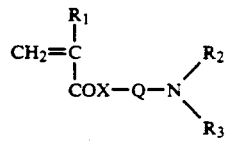

(I)

[in which $R_1$ is hydrogen or a methyl group, $R_2$ and $R_3$ are respectively hydrogen or an alkyl group having 1 to 20 carbon atoms, X is oxygen or nitrogen, and Q is an alkylene group or an allylene group.]

Fluorine atom is effective to control negative charges. Fluorine-containing monomers are exemplified with no significance of limitation by fluoroalkyl(metha)acrylate, such as 2,2,2-trifluoroethyl acrylate, 2,2,3,3-tetrafluoropropyl acrylate, 2,2,3,3,4,4,5,5-octafluoroamyl acrylate, 1H,1H,2H,2H-heptadecafluorodecyl acrylate It is, however, not always necessary to add such the charge controlling agents or the above described polar group-containing resins to the toner for use in the development of an electrostatic latent image according to the present invention. If the developing sleeve, toner-regulating blade and the like in the single-component system and the carrier in the binary system having a sufficient difference from the toner in chargeability are used respectively, the toner can be charged as desired.

The toner for use in the development of an electrostatic latent image according to the present invention has the above described layered structure and exhibits the stabilized chargeability, fixing property, heat resistance and the like. It is further desirable that as to the shape characteristics of the finally obtained toner, the coefficient of variation of the particle size is less than 20 %, preferably less than 10 %, and the shape coefficient (SF1) is within the range of 110 to 140. That is to say, in the case where the toner particle has a remarkably high spherical degree and a narrow distribution of particle size, even when the particle size of toner is intended to be made small, the high fluidity and the stabilized and uniform chargeability characteristics can be given and the stabilized developing property can be given without producing problems such as fogs and the flying of the toner.

EXAMPLES OF THE PRODUCTION OF CORE PARTICLES S-I

| Ingredient | Parts by weight |
|---|---|
| Styrene-n-butyl methacrylate resin: (St;BMA = 7/3) (softening point: 108° C.; glass transition point: 52° C.: Mn = 12,000; Mw/Mn = 14; Tf: 100° C.) | 100 |
| Carbon black (MA#8 made by Mitsubishi Kasei Kogyo K.K.) | 5 |
| Low molecular polypropylene (Viscol 550P made by Sanyo Kasei Kogyo K.K.) | 4 |

The above described ingredients were sufficiently blended in a ball mill and then the resulting mixture was kneaded by means of a three-roll heated at 140 ° C. The kneaded mixture was left as it was to be cooled and then roughly pulverized in a feather mill, followed by finely pulverizing in a jet mill. Subsequently, the resulting particles were subjected to air-classification to obtain fine particles having a mean particle size of 11 μm. The obtained fine particles are called the core particles S-I.

EXAMPLE OF THE PRODUCTION OF CORE PARTICLES S-II

Fine particles having a mean particle size of 11 μm were obtained in the same manner as in Example of the production of core particles S-I excepting that carbon black was not added. The obtained fine particles are called the core particles S-II.

EXAMPLE OF THE PRODUCTION OF CORE PARTICLES S-III

| Ingredient | Parts by weight |
|---|---|
| Styrene | 70 |
| N-butyl methacrylate | 28 |
| Methacrylic acid | 2 |
| 2,2-azobis-(2,4-dimethylvaleronitrile) (first grade made by Wako Junyaku Kogyo K.K.) | 0.5 |

The above described materials were sufficiently blended in a sand stirrer to prepare a polymerizable composition. This polymerizable composition was subjected to the polymerization reaction for 6 hours at 60 ° C. in an aqueous solution of Arabic rubber having a concentration of 3 % by weight with stirring at 3,200 rpm in a stirrer—T.K. AUTO HOMO MIXER (made by Tokushu Kika Kogyo K.K.)—followed by rising the temperature up to 80 ° C. to continue the polymerization reaction. After the completion of the polymerization reaction, the reaction mixture was cooled and then washed 5 times followed by filtrating and drying to obtain spherical particles.

The obtained spherical particles were further subjected to the air classification to obtain the spherical particles having a mean particle size of 11 μm. These spherical particles are called the core particles S-III.

The number average molecular weight (Mn) of these spherical particles was 9600, Mw/Mn was 10, the softening point (Tm) was 110 ° C., the glass transition temperature (Tg) was 51 ° C.

PREPARATION EXAMPLE OF CORE PARTICLES S-IV

| | |
|---|---|
| Spherical particles S-IV with mean particle size; | 10 μm |
| number average molecular weight (Mn); | 9400 |
| dispersion degree (Mw/Mn); | 4 |
| glass transition point (Tg); | 50° C. |
| softening point (Tm); | 103° C. |

were prepared under altered polymerization conditions from those of Preparation Example of Core Particles S-III.

PREPARATION EXAMPLE OF CORE PARTICLES E-I

One hundred parts by weight of polyester resin (Mn=3800; Mw/Mn=2.8; Tg=60 ° C.; Tf=110 ° C.) was mixed sufficiently in a ball mill, and kneaded over a three-roll heated to 140 ° C. The kneaded mixture was left to stand for cooling the same, and then, was coarsely pulverized with the use of a feather mill. The obtained coarse particles were further pulverized by a jet mill, followed by being air-classified to obtain fine particles with an average particle size of 11 μm. The resultant fine particles are referred to as Core Particle E-I.

PREPARATION EXAMPLE OF CORE PARTICLES E-II

Core Particles E-II with mean particle size of 11 μm were prepared in a similar composition and manner to Preparation Example of Core Particles E-I, except that graft polymer of styrene-butyl acrylate-polyester (Mn=3200; Mw/Mn=8.7; Tg=58° C.; Tf=105° C.) was used instead of polyester resin.

PREPARATION EXAMPLE OF CORE PARTICLES E-III

Core Particles E-III with mean particle size of 11 μm were prepared in a similar composition and manner to preparation Example of Core Particles E-I, except that polyester resin (Mn=5600; Mw/Mn=25; Tg=67° C.; Tf=120° C.) was used.

METHOD OF PRODUCING FINE RESIN PARTICLES

Monomer compositions shown in Table 1, polyvinyl alcohol saponified completely in ion-exchanged water, and sodium dodecylbenzene sulfonate as an emulsifying agent were added to reaction vessel provided with a stirrer, a condenser and a thermometer, then the obtained mixture were subjected to emulsion polymerization in the presence of sodium persulfate as a polymerization initiator with stirring and heating to form fine particles. Then, the resulting particles were coagulated by the use of calcium chloride in an aqueous dispersion system. Successively, the coagulated product was washed with water, filtrated and dried in vacuum, followed by pulverizing in a jet pulverizer to obtain fine resin particles A to N shown in Table 1.

The obtained fine particles were evaluated on the following items. The results are shown in Table 1.

Measurements of the Number Average Molecular Weight (Mn) and the Dispersion (Mw/Mn)

The number average molecular weight and the dispersion were measured by gel-permeation chromatography under the following conditions and shown by numeral values converted from a calibration curve prepared for standard polystyrene.

Detector: RID-300 type differential refractometer (made by Nihon Bunko Kogyo K.K.)

Column: A-80M×2

Temperature: 35 ° C.

Solvent: THF

Flow rate: 1.0 ml/min

Method of Measuring Value of Tf—Temperature at which Molten Viscosity Amounts to $10^6$ poises in Flow Tester The molten viscosity was measured under the following measuring conditions in flow tester Model CFT-500 made by Shimazu Seisakusho K.K.

Nozzle: 1ϕ×1 mm

Temperature-rising rate: 3° C./min

Load: 20 kg/cm$^2$

The temperature, at which the molten viscosity amounts to $10^6$ poises, was adopted as the Tf value.

Glass Transition Temperature (Tg)

The glass transition temperature (Tg) was expressed by the value measured by means of the differential scanning calorimeter SSC/580 DSC20 made by Seiko Denshi Kogyo K.K.

Quantity of the Gel Components

The quantity of gel components is a quantity of resinous components which are not dissolved in toluene. The respective values shown in the present specification were obtained by the following measuring method. That is to say, a thermoplastic resin (Ms)[g] to be measured is extracted by means of means of Soxhlet extractor by the use of a glass filter (G-3). Thus the toluene-soluble components contained in the resin are removed and then the insoluble components (Mr) are dried followed by measuring the weight [g]. The thus obtained % by weight of the insoluble components was adopted as the quantity of the gel components.

The quantity of the gel components=(Mr/Ms)×100

TABLE 1

| fine resin particle | monomer *1 composition | particle size (μm) | Mn (× $10^4$) | Mw/Mn | Tf (°C.) | Tg (°C.) | coefficient of variation | SF1 | amount of gel component |
|---|---|---|---|---|---|---|---|---|---|
| A | MMA/BA = 90/10 | 0.16 | 1.6 | 2.3 | 115 | 61 | 8 | 106 | 0 |
| B | ST/BA/2EHA = 50/30/20 | 0.16 | 1.4 | 2.5 | 90 | 63 | 6 | 105 | 0 |
| C | ST/BA = 90/10 | 0.15 | 1.5 | 2.5 | 90 | 62 | 7 | 104 | 0 |
| D | ST/MMA/BA = 50/30/20 | 0.16 | 1.5 | 2.3 | 105 | 58 | 7 | 106 | 0 |
| E | ST/BA = 30/70 | 0.16 | 1.6 | 2.3 | 110 | 64 | 7 | 104 | 0 |
| F | MMA/BA = 90/10 | 0.16 | 30.0 | 3.7 | 145 | 69 | 6 | 104 | 0 |
| G | ST/BA = 80/20 | 0.17 | 17.7 | 2.5 | 145 | 69 | 8 | 105 | 0 |
| H | ST = 100 | 0.16 | 14.8 | 2.4 | 148 | 71 | 7 | 106 | 0 |
| I | ST/BA = 70/30 | 0.16 | 18.5 | 2.3 | 150 | 78 | 8 | 106 | 0 |
| J | ST/BA = 70/30 | 0.15 | 8.0 | 2.5 | 130 | 69 | 7 | 105 | 0 |
| K | P-MMA = 100 | 0.15 | 27.3 | 5.4 | 220 | 120 | 7 | 106 | 0 |
| L | ST = 100 | 0.16 | 70.0 | 6.2 | 200 | 94 | 8 | 107 | 0 |
| M | ST/BMA = 20/80 | 0.15 | 25.0 | 4.9 | 155 | 70 | 8 | 108 | 0 |
| N | ST/MMA = 90/10 | 0.16 | 31.5 | 4.2 | 113 | 68 | 7 | 106 | 0 |

*: MMA = methyl methacrylate, BA = butyl acrylate, ST = styrene 2EHA = 2-ethylhexyl acrylate, P-MMA = poly(methyl methacrylate)

Production of Toner S-1 to S-9

Core particles and fine resin particles, which had been obtained in the above described manner, were blended together with coloring agents in the combinations and compositions shown in the following Table 2 and then the resulting mixtures were mixed and stirred at 1,500 rpm for 2 minutes in Henschel mixer having the capacity of 10 liters to adhere the fine resin particles and the coloring agents to the surface of the core particles.

Subsequently, the obtained mixtures of 150 g were put into Hybridizer NHS-1 (made by Nara Kikai Seisakusho K.K.) to be treated for 8 minutes at a peripheral speed of the blade of 78 m/sec and at room temperature, whereby forming uniform intermediate layers containing the coloring agents on the surface of the core particles.

Successively, the fine resin particles and charge controlling agents were treated in the same manner as in the formation of the intermediate layer excepting that they were blended in the combinations and compositions shown in the following Table 2 to form outermost surface layers containing the charge controlling agents, whereby obtaining the toner S-1 to S-9 shown in Table 2.

TABLE 2

| | intermediate layer | | | | | | outermost surface layer | | | | |
|---|---|---|---|---|---|---|---|---|---|---|---|
| | core particle | | fine resin particle | | coloring agent | | fine resin particle | | charge controlling agent | | toner weight |
| Ex. (Com. Ex.) Toner | sample | amount (parts by weight) | sample | amount (parts by weight) | sample | amount (parts by weight) | sample | amount (parts by weight) | sample | amount (parts by weight) | average particle size (m) |
| Ex. 1 S-1 | S-I | 80 | A | 10 | — | — | L | 20 | *1 | 0.2 | 12.0 |
| Ex. 2 S-2 | S-I | 80 | B | 10 | — | — | G | 20 | *1 | 0.2 | 11.9 |
| Ex. 3 | S-II | 80 | E | 10 | **1 | 10 | I | 20 | *1 | 0.2 | 12.0 |

TABLE 2-continued

| Ex. (Com. Ex.) Toner | intermediate layer: core particle sample | core particle amount (parts by weight) | fine resin particle sample | fine resin particle amount (parts by weight) | coloring agent sample | coloring agent amount (parts by weight) | outermost surface layer: fine resin particle sample | fine resin particle amount (parts by weight) | charge controlling agent sample | charge controlling agent amount (parts by weight) | toner weight average particle size (m) |
|---|---|---|---|---|---|---|---|---|---|---|---|
| S-3 | | | | | | | | | | | |
| Ex. 4 S-4 | S-III | 80 | H | 10 | **1 | 10 | K | 20 | *2 | 0.2 | 12.1 |
| Ex. 5 S-5 | S-IV | 80 | C | 10 | **2 | 5 | I | 20 | *3 | 0.5 | 11.2 |
| C. Ex. 1 S-6 | S-I | 80 | D | 10 | — | — | B | 20 | *1 | 0.2 | 11.9 |
| C. Ex. 2 S-7 | S-II | 80 | I | 10 | **1 | 10 | J | 20 | *1 | 0.2 | 12.0 |
| C. Ex. 3 S-8 | S-II | 80 | F | 10 | **1 | 10 | K | 20 | *2 | 0.2 | 12.1 |
| C. Ex. 4 S-9 | S-IV | 80 | C | 10 | **2 | 5 | C | 20 | *3 | 0.2 | 11.0 |

*1: Spilon Black TRH, dye of chromium complex salt type (made by Hododani Kagaku Kogyo K.K.)
*2: Nigrosine Base EX (made by Orient Kagaku Kogyo K.K.)
*3: Quarternary Ammonium Salt P-51 (made by Orient Kagaku Kogyo K.K.)
**1: Carbon Black MA#8 (made by Mitsubishi Kasei Kogyo K.K.)
**2: phthalocyanine pigment (C.I. 74160)

Production of Toner E-1 to E-8

Core particles and fine resin particles, which had been obtained in the above described manner, were blended together with coloring agents in the combinations and compositions shown in the following Table 3 and then the resulting mixtures were mixed and stirred at 1,500 rpm for 2 minutes in Henschel mixer having the capacity of 10 liters to adhere the fine resin particles and the coloring agents to the surface of the core particles.

Subsequently, the obtained mixtures of 150 g were put into Hybridizer NHS-1 (made by Nara Kikai Seisakusho K.K.) to be treated for 8 minutes at a peripheral speed of the blade of 78 m/sec and at room temperature, whereby forming uniform intermediate layers containing the coloring agents on the surface of the core particles.

Successively, the fine resin particles and charge controlling agents were treated in the same manner as in the formation of the intermediate layer excepting that they were blended in the combinations and compositions shown in the following Table 3 to form outermost surface layers containing the charge controlling agents, whereby obtaining the toner E-1 to E-8 shown in Table 3.

TABLE 3

| Ex. (Com. Ex.) Toner | intermediate layer: core particle sample | core particle amount (parts by weight) | fine resin particle sample | fine resin particle amount (parts by weight) | coloring agent sample | coloring agent amount (parts by weight) | outermost surface layer: fine resin particle sample | fine resin particle amount (parts by weight) | charge controlling agent sample | charge controlling agent amount (parts by weight) | toner weight average particle size (m) |
|---|---|---|---|---|---|---|---|---|---|---|---|
| Ex. 6 E-1 | E-I | 80 | B | 10 | **1 | 5 | H | 20 | dye of zinc complex salt type *1 | 0.2 | 12.0 |
| Ex. 7 E-2 | E-I | 80 | C | 10 | **1 | 5 | K | 20 | quarternary ammonium salt *2 | 0.5 | 11.9 |
| Ex. 8 E-3 | E-II | 80 | G | 10 | **1 | 5 | L | 20 | dye of zinc complex salt type *1 | 0.2 | 12.1 |
| Ex. 9 E-4 | E-II | 80 | E | 10 | **1 | 5 | I | 20 | dye of zinc complex salt type *1 | 0.2 | 12.0 |
| Ex. 10 E-5 | E-III | 80 | D | 10 | **2 *3 | 10 | H | 20 | dye of chromium complex salt type *4 | 0.2 | 11.9 |
| C. Ex. 5 E-6 | E-I | 80 | F | 10 | **1 | 5 | A | 20 | quarternary ammonium salt *2 | 0.2 | 11.9 |
| C. Ex. 6 E-7 | E-II | 80 | I | 10 | **1 | 5 | J | 20 | dye of zinc complex salt type *1 | 0.2 | 12.0 |
| C. Ex. 7 E-8 | E-III | 80 | L | 10 | **2 | 10 | H | 20 | dye of chromium complex salt type *4 | 0.2 | 11.9 |

*1: Dye of Zinc Complex Salt Type E-84 (made by Orient Kagaku Kogyo K.K.)
*2: Quarternary Ammonium Salt P-51 (made by Orient Kagaku Kogyo K.K.)
*3: Carbon Black MA#8 (made by Mitsubishi Kasei Kogyo K.K.)
*4: Spilon Black TRH (made by Hododani Kagaku Kogyo K.K.)
**1: Phthalocyanine Pigment (C.I.74160)
**2: Carbon Black MA#8

Production of Carriers

| Ingredient | Parts by weight |
|---|---|
| Polyester resin (softening point: 123° C.; glass transition point: 65° C.; AV: 23; OHV: 40) | 100 |
| Fe—Zn family ferrite fine particles MFP-2 (made by TDK K.K.) | 500 |
| Carbon black (AM#8 made by Mitsubishi Kasei Kogyo K.K.) | 2 |

The above described materials were sufficiently mixed and ground in Henschel mixer and then molten and kneaded in the extrusion kneader of which cylinder portion was set at 180 ° C. and cylinder head portion was set at 170 ° C. The kneaded mixture was left as it was to be cooled and then roughly pulverized in feather mill followed by finely pulverizing in jet mill. The obtained particles were classified in classifier to obtain carriers having a mean particle size of 60 μm.

Evaluation Methods

The obtained toner S-1 to S-3 and E-1 to E-8 each of which of 100 parts by weight was subjected to the after-treatment with colloidal silica R-972 (made by Nippon Aerosil K.K.) of 0.1 part by weight, was evaluated on the following various kinds of characteristic. The results are shown in Table 4.

1. Content of fine particles (particle size distribution measurement)

Toner S-1 to S-9 and E-1 to E-8 were mixed respectively with carrier at the ratio of toner to carrier of 7/93 to prepare a two component developer. The obtained developers were subjected a copying process using copying machine EP-570Z (made by Minolta Camera K.K.)

for toner S-1, S-2, S-3, S-6, S-7, E-1 to E-5, E-7 and E-8, copying machine EP-470Z (made by Minolta Camera K.K.)

for toners S-4 and S-8, modified copying machine EP-470Z in which fixing roll was coated with oil for toner S-5 and S-9, and modified copying machine EP-570Z in which fixing roll was coated with oil for toner E-2 and E-6.

After the copying process was repeated 50,000 times, the amount of fine particles of toner was measured.

In the content measurement of the fine particles, first, the particle size distribution by number was measured and the content of particles within the range of between 0.5 μm or more and less than half of weight average particle size in the distribution measurement was represented by percent by weight.

The particle size distribution was measured as follows;

First, about 5 g of developer was sampled from 5 different portions in the developing device. The sample was dispersed in an aqueous solution containing a surfactant. The dispersion was subjected to an ultrasonic irradiation. Carrier particles were removed with magnet. Then, the particle size distribution was measured by SALD-1100 (made by Shimazu Seisakusho K.K.), which is a particle size distribution measuring machine of laser diffraction type;

2. Durability test with respect to copy (black spot)

A standard chart of Dataquest Company was copied 100,000 times under adequate irradiation conditions. During this process, the quality of copied images were evaluated visually, the amount of aggregated particles in the developing device during mixing and stirring were checked and ranked. When the evaluation is "Δ" rank or better, the toner can be put into practical use.

However, the rank of "○" is preferable.

3. Evaluation of light transmittance

At the initial stage of the durability test, toner was developed onto a OHP sheet. The OHP sheet with copied images was projected onto a screen through an overhead projector. The light-transmittance was evaluated from projected color tone on the screen and ranked. When the evaluation is "Δ" rank or better, the toner can be put into practical use. However, the rank of "○" is preferable.

TABLE 4

| Ex. Com. Ex. | core particle (parts by weight) Mn | resin particle for intermediate layer (parts by weight) Mn | resin particle for outermost surface layer (parts by weight) Mn | content of fine particle (% by number) initial | content of fine particle (% by number) after 5000 times | black spots in copied image initial | black spots in copied image after 5000 times | black spots in copied image after 100000 times | light-trans-mittance |
|---|---|---|---|---|---|---|---|---|---|
| Ex. 1 | S-I (80) 12000 | E (10) 16000 | L (20) 700000 | 10.3 | 17.3 | ○ | ○ | ○ | — |
| Ex. 2 | S-I (80) 12000 | B (10) 14000 | G (20) 177000 | 12.1 | 19.0 | ○ | ○ | ○ | — |
| Ex. 3 | S-II (80) 12000 | E (10) 16000 | I (20) 185000 | 11.8 | 19.1 | ○ | ○ | ○ | — |
| Ex. 4 | S-III (80) 9600 | H (10) 148000 | K (20) 273000 | 14.4 | 20.6 | ○ | ○ | ○ | — |
| Ex. 5 | S-IV (80) 9400 | C (10) 15000 | I (20) 185000 | 8.9 | 14.7 | ○ | ○ | ○ | ○ |
| C. Ex. 1 | S-I (80) 12000 | D (10) 15000 | B (20) 14000 | 14.5 | 46.1 | ○ | | x | — |
| C. Ex. 2 | S-II (80 12000 | I (10) 185000 | J (20) 80000 | 13.1 | 39.7 | ○ | | x | — |
| C. Ex. 3 | S-II (80) 12000 | F (10) 300000 | K (20) 273000 | 14.1 | 42.2 | ○ | x | x | — |
| C. Ex. 4 | S-IV (80) 9400 | C (10) 15000 | C (20) 15000 | 11.7 | **1 | | **1 | | ○ |
| Ex. 6 | E-I (80) 3800 | B (10) 14000 | H (20) 148000 | 10.9 | 15.1 | ○ | ○ | ○ | ○ |
| Ex. 7 | E-I (80) 3800 | C (10) 15000 | K (20) 273000 | 12.1 | 14.7 | ○ | ○ | ○ | ○ |

TABLE 4-continued

| Ex. Com. Ex. | core particle (parts by weight) Mn | resin particle for intermediate layer (parts by weight) Mn | resin particle for outermost surface layer (parts by weight) Mn | content of fine particle (% by number) initial | content of fine particle (% by number) after 5000 times | black spots in copied image initial | black spots in copied image after 5000 times | black spots in copied image after 100000 times | light-transmittance |
|---|---|---|---|---|---|---|---|---|---|
| Ex. 8 | E-II (80) 3200 | G (10) 177000 | L (20) 700000 | 10.3 | 13.2 | ○ | ○ | ○ | ○ |
| Ex. 9 | E-II (80) 3200 | E (10) 16000 | I (20) 185000 | 12.5 | 15.0 | ○ | ○ | ○ | ○ |
| Ex. 10 | E-III (80) 5600 | D (10) 15000 | H (20) 148000 | 11.0 | 21.0 | ○ | ○ | ○ | — |
| C. Ex. 5 | E-I (80) 3800 | F (10) 300000 | A (20) 16000 | 15.0 | 47.1 | ○ | x | x | |
| C. Ex. 6 | E-II (80) 3200 | I (10) 185000 | J (20) 80000 | 12.9 | 40.9 | ○ | x | x | |
| C. Ex. 7 | E-III (80) 5600 | L (10) 700000 | H (20) 148000 | 13.0 | 38.8 | ○ | | x | — |

**1: stopped 2000 times because of aggregation in developing machine

What is claimed is:

1. Toner for developing electrostatic latent images comprising:

a core particle comprising resin with 1000–100000 in number average molecular weight ($Mn_1$), an intermediate layer coating the core particle and comprising resin with 5000–300000 in number average molecular weight ($Mn_2$) and, an outermost surface layer coating the intermediate and comprising resin with 10,000–1,000,000 in number average molecular weight ($Mn_3$);

the number average molecular weights $Mn_1$, $Mn_2$ and $Mn_3$ satisfies the relationship of;

$$Mn_1 < Mn_2 < Mn_3$$

2. Toner of claim 1, in which the core particle comprising a styrene-acrylic copolymer with 2,500–100,000 in number average molecular weight.

3. Toner of claim 1, in which the core particle is a light-transmittable resin particle comprising styrene-acrylic copolymer with 2,500–12,000 in number average molecular weight.

4. Toner of claim 1, in which the core particle comprises a polyester resin with 1,000–20,000 in number average molecular weight.

5. Toner of claim 1, in which the core particles are 1–20 μm in mean particle size.

6. Toner of claim 1, in which the intermediate layer comprises a styrene-acrylic copolymer resin.

7. Toner of claim 1, in which the intermediate layer has thickness of about one fifth or less of mean particle size of core particles.

8. Toner of claim 1, in which fine resin particles with particle size of about one fifth of the mean particle size or less are adhered to the surface of the core particle, and being softened by heat or mechanical impact to form the intermediate layer.

9. Toner of claim 8, in which the fine resin particles are 0.05–3 μm in mean particle size.

10. Toner of claim 8, in which the usage of the fine resin particles is 5–50 parts by weight on the basis of 100 parts by weight of the core particles to form the intermediate layer.

11. Toner of claim 1, in which the outermost surface layer comprises styrene-acrylic copolymer.

12. Toner of claim 1, in which fine resin particles are adhered to the surface of the intermediate layer, and being softened by heat or mechanical impact to form the outermost surface layer.

13. Toner of claim 12, in which the fine resin particles are 0.05–3 μm in mean particle size.

14. Toner of claim 1, in which the outermost surface layer comprises a charge controlling agent.

15. Toner of claim 14, in which the addition amount of the charge controlling agent is 0.1–10 parts by weight on the basis of 100 parts by weight of the resin fine particles used for forming the outermost surface layer.

16. Toner of claim 11, in which the acrylic monomer component of the styrene-acrylic copolymer used for forming the outermost surface layer comprises fluorine atoms.

17. Toner of claim 11, in which the acrylic monomer component of the styrene-acrylic copolymer used for forming the outermost surface layer is amino(metha)acrylic monomer represented by the following general formula:

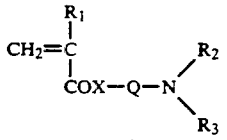

in which $R_1$ is hydrogen or a methyl group, $R_2$ and $R_3$ are respectively hydrogen or an alkyl group having 1 to 20 carbon atoms, X is oxygen or nitrogen, and Q is an alkylene group or an allylene group.

18. Toner for developing electrostatic latent images comprising:

a core particle comprising resin with 1,000–100,000 in number average molecular weight ($Mn_1$), an intermediate layer coating the core particle and comprising styrene-acrylic copolymer resin with 5,000–300,000 in number average molecular weight ($Mn_2$) and, an outermost surface layer coating the intermediate layer and comprising styrene-acrylic copolymer resin with 10,000–1,000,000 in number average molecular weight ($Mn_3$)

19. Toner of claim 18, having less than 20 % or less in coefficient of variation of the toner represented by:

$$\sigma = \sqrt{\frac{(x_1 - \bar{x})^2 + (x_2 - \bar{x}) + \ldots \ldots + (xn - \bar{x})^2}{n - 1}}$$

$$= \sqrt{\frac{1}{n - 1}\left[\Sigma\, xi^2 - \frac{(\Sigma xi)^2}{n}\right]}$$

in which $X_1$, $X_2$–$X_n$ represent respective particle sizes of sample particles, X represents the mean value of the n particle sizes.

20. Toner of claim 18, having 110–140 in shape coefficient represented by;

$$SF1 = \frac{(\text{maximum length})^2}{(\text{area})} \times \frac{(\pi)}{4} \times 100$$

in which "area" means an average value of the projected area of particles and "maximum length" means an average value of the longest length in the projected image of particles.

21. Toner for developing electrostatic latent images comprising:

a core particle comprising thermoplastic resin, an intermediate layer coating the core particle and comprising styrene-acrylic copolymer resin with higher number average molecular weight than that of the thermoplastic resin of the core particle, an outermost surface layer coating the intermediate layer and comprising styrene-acrylic copolymer resin with higher number average molecular weight than that of the styrene-acrylic copolymer resin used for forming the intermediate layer.

* * * * *